US008156618B2

(12) United States Patent
Reutter et al.

(10) Patent No.: US 8,156,618 B2
(45) Date of Patent: Apr. 17, 2012

(54) DEVICE FOR NEEDLING A FIBROUS WEB

(76) Inventors: Tilman Reutter, Eidenberg (AT); Andreas Plump, Linz (AT); Andreas Mayer, Erlangen (DE); Daniel Bu, Ansfelden (AT)

( * ) Notice: Subject to any disclaimer, the term of this patent is extended or adjusted under 35 U.S.C. 154(b) by 0 days.

(21) Appl. No.: 12/669,763

(22) PCT Filed: Jul. 16, 2008

(86) PCT No.: PCT/EP2008/059291
§ 371 (c)(1),
(2), (4) Date: Jun. 10, 2010

(87) PCT Pub. No.: WO2009/019111
PCT Pub. Date: Feb. 12, 2009

(65) Prior Publication Data

US 2010/0306978 A1 Dec. 9, 2010

(30) Foreign Application Priority Data

Aug. 4, 2007 (DE) ..... 10 2007 036 897

(51) Int. Cl.
*D04H 18/00* (2006.01)

(52) U.S. Cl. ..... 28/107; 28/114

(58) Field of Classification Search ..... 28/107, 28/114, 113, 108–112, 115; 112/80.4, 80.42
See application file for complete search history.

(56) References Cited

U.S. PATENT DOCUMENTS 3,830,174 A * 8/1974 Mellor ..... 112/80.42
4,241,479 A 12/1980 Dilo
5,390,556 A * 2/1995 Nencini et al. ..... 74/38
5,502,879 A * 4/1996 Rinder ..... 28/115
5,511,294 A * 4/1996 Fehrer ..... 28/113
5,528,805 A * 6/1996 Leuchtenmuller et al. ..... 28/115
5,548,881 A * 8/1996 Ludwig ..... 28/114
5,551,134 A 9/1996 Fehrer
5,568,678 A * 10/1996 Fehrer ..... 28/115

(Continued)

FOREIGN PATENT DOCUMENTS

AT 400 151 10/1995

(Continued)

OTHER PUBLICATIONS

International Preliminary Report on Patentability for International Application No. PCT/EP2008/059291 dated Mar. 2, 2010.

(Continued)

*Primary Examiner* — Amy Vanatta
(74) *Attorney, Agent, or Firm* — Alston & Bird LLP

(57) ABSTRACT

The invention relates to a device for needling a fibrous web having at least one needle bar. The needle bar carries a needle board on the bottom thereof having a plurality of needles, the needle bar being guided by means of a moveably mounted bar carrier. The bar carrier is driven by a vertical drive in an oscillating manner in up and down movements. For straight guidance of the bar carrier, a guiding device is provided, which has at least one rocker held at the end by a rotary bearing of a machine frame. In order to obtain the straightest possible guide path in the bar carrier, according to the invention the opposite end of the rocker and the bar carrier are connected by a plurality of members of a coupling kinematic mechanism.

21 Claims, 5 Drawing Sheets

U.S. PATENT DOCUMENTS

| | | | | |
|---|---|---|---|---|
| 5,732,453 | A * | 3/1998 | Dilo et al. | 28/114 |
| 6,161,269 | A | 12/2000 | Dilo et al. | |
| 6,266,856 | B1 * | 7/2001 | Fehrer et al. | 28/107 |
| 6,389,665 | B1 * | 5/2002 | Fuchs et al. | 28/114 |
| 6,481,071 | B1 * | 11/2002 | Fehrer et al. | 28/107 |
| 6,584,659 | B2 * | 7/2003 | Legl et al. | 28/114 |
| 6,748,633 | B2 * | 6/2004 | Legl et al. | 28/114 |
| 7,373,705 | B2 * | 5/2008 | Jean et al. | 28/113 |
| 2003/0056347 | A1 * | 3/2003 | Pum | 28/107 |
| 2007/0006432 | A1 | 1/2007 | Noel et al. | |
| 2009/0119894 | A1 * | 5/2009 | Reutter et al. | 28/114 |

FOREIGN PATENT DOCUMENTS

| | | |
|---|---|---|
| EP | 0 364 105 | 4/1990 |
| GB | 2 381 276 | 4/2003 |

OTHER PUBLICATIONS

International Search Report for International Application No. PCT/EP2008/059291.

* cited by examiner

DEVICE FOR NEEDLING A FIBROUS WEB

BACKGROUND OF THE INVENTION

Field of the Invention

The present invention relates to a device for needling a fibrous web.

Description of the Related Art

For consolidating and structuring laid fibrous webs, it is known from the prior art to pierce the fibrous webs with a plurality of needles, which are guided in an oscillating upward and downward movement. Since the needles are not smooth but provided with barbed hooks that are open in the piercing direction, individual fibers of the fibrous web are caught and realigned within the fibrous web when the needles pierce the latter. This results in the desired fiber-mingling and bonding effects within the fibrous web. For guiding the plurality of needles, devices are used in which the needles are disposed on a lower side of a needle beam. The needle beam is held with the aid of a movable beam carrier, which is driven by means of a vertical drive for an oscillating vertical movement. In order to enable the straightest possible insertion of the needles into the fibrous web during the vertical movement, it is further known from the prior art to use a guiding device, which acts on the beam carrier and which guides the vertical movement of the beam carrier.

A device for needling a fibrous web is thus disclosed in DE 44 31 055 A1, in which device the guiding device is formed by a rocker, one end of which is held on a machine frame with the aid of a rotary bearing and the opposite free end of which is coupled to the beam carrier via a swivel joint. The beam carrier is thus guided on a guideway predetermined by the rocker. The guideway of the beam carrier is shaped like a circular arc. In order to still produce defined punctures with the help of the needles, curved needles are used that are adapted to the guideway of the beam carrier.

U.S. Pat. No. 4,241,479 discloses another device for needling a fibrous web, in which device the guiding device for the straight guidance of the beam carrier is formed by two rockers that are held in supporting bearings in relation to a machine frame. The supporting bearings each comprise at least one tooth gap, in which that end of the rocker that is formed as a tooth engages. The device disclosed thus requires more space in order to be able to guide the outwardly protruding rockers in the machine frame. Furthermore, the lubrication and sealing of the teeth disposed between the rockers and the supporting bearings pose problems, in particular.

EP 0 364 105 A1 discloses another device for needling a fibrous web, in which device the guiding device comprises at least one guiding rod that is guided in a guide bushing held on a machine frame. One free end of the guiding rod is connected to the beam carrier so that the beam carrier maintains a guideway predetermined by the guiding rod and the guide bushing during the vertical movement. The device disclosed is also based on a tribological pairing of two parts for guiding the beam carrier, and the lubrication and sealing of these parts pose problems, in particular, and require a large amount of equipment.

Moreover, the guiding devices for the straight guidance of the beam carrier known from the prior art only allow the needle beam to be driven in the vertical direction. Retrofits of the known devices for carrying out a horizontal movement of the beam carrier are either not feasible or are associated with considerable expenditure.

SUMMARY OF VARIOUS EMBODIMENTS

It is now the object of the present invention to design a device for needling a fibrous web of the generic kind, which device comprises a guiding device, which enables a straight guidance of the beam carrier in the longitudinal direction by means of a compact and simple coupling kinematic mechanism.

Another aim of the invention is to design a flexible and reliable guiding device for the straight guidance of the beam carrier in the device of the invention.

This object is achieved according to the invention by a device for needling a fibrous web, which device has the features of various embodiments.

Preferred developments of the invention are defined by the features and combinations of features of the respective dependent claims.

One particular advantage of the invention is that the linkage of the beam carrier in relation to the machine frame with the aid of a rocker guided in the rotary bearing is retained. The guideway predetermined by the rocker can be converted advantageously by interposing a coupling kinematic mechanism and can be adapted to match the requirements of the needling process. According to the invention, the opposite end of the rocker is connected to the beam carrier with the aid of a plurality of members of a coupling kinematic mechanism. The guideway that is effective on the beam carrier for the straight guidance of the needle beam can thus be determined by the cooperation of the rocker and the coupling kinematic mechanism.

In a preferred development of the invention, the members of the coupling kinematic mechanism are formed by a steering rod and a frame lever, the steering rod being connected to the beam carrier with the aid of a swivel joint, and the frame lever being held on the machine frame with the aid of a rotary bearing. The vertical movement of the beam carrier can thus be received and guided exclusively by pivoted levers of the guiding devices. The rotational movements of the lever means can be enabled advantageously by the rotary bearings or swivel joints so that the entire guiding device has a simple tribology. Both the rotary bearings and the swivel joints can easily be sealed in relation to the ambience so that a stable and secure guidance of the beam carrier is ensured.

Depending on the design of the frame lever within the coupling kinematic mechanism, it is possible to implement different guideways for the straight guidance of the beam carrier. In a first variant, the frame lever is formed as a tilting lever comprising the rotary bearing in a central portion thereof. One end of the tilting lever is connected to the steering rod with the aid of a swivel joint and the opposite end is connected to the rocker by means of a second swivel joint. The guideway effected by the steering rod on the beam carrier can be formed such that it is approximately straight depending on the coordination of the lengths of the steering rod and the tilting lever.

In order to produce a straight guideway of the beam carrier in a narrow space as far as possible, the frame lever is formed as a second rocker according to a preferred development of the invention, the first rocker and the second rocker being each connected to the steering rod with the aid of a swivel joint. The selection of the positions of the rotary bearings and the lengths of the rockers enables an almost straight pivot point between the steering rod and the beam carrier over a maximum vertical stroke. This variant of the invention is particularly suitable to carry out high-quality needling processes on fibrous webs. The plurality of needles can be guided on the needle beam precisely in a vertical upward and downward movement for needling the fibrous web so that a very uniform needling structure can be produced within the fibrous web.

The selection of the rocker arrangement is user-definable depending on the machine type, the installation options and the desired guiding properties. Thus, for example, the swivel joints of the rockers can be formed on the steering rod at a distance from each other, the swivel joint between the beam carrier and the steering rod being formed at a free end of the steering rod or in a central portion of the steering rod.

This variant of the invention can be developed in such a way to particular advantage that one of the rotary bearings of the rockers is formed as an eccentric bearing at the circumference of an eccentric shaft, which eccentric shaft can be optionally driven or locked into position by means of a kinetic facility. This provides the possibility of producing a constant horizontal stroke on the beam carrier. For this purpose, the eccentric shaft can be driven by means of the kinetic facility. Alternately, the eccentric shaft is locked into position by the kinetic facility, if required, so that only the straight guidance produced by the steering rod is effective on the beam carrier.

Depending on the design of the steering rod and the linkage of the swivel joints of the rockers, the two rotary bearings of the rockers are preferably disposed at a distance from each other above the beam carrier. Particularly compact and space-saving guiding devices can thus be achieved.

In order to improve the guiding stability of the beam carrier, the two rotary bearings of the rockers are disposed symmetrically in relation to the center of the beam carrier according to a preferred development of the invention.

For this purpose, the swivel joint is preferably disposed at the center of the beam carrier for the linkage of the steering rod. The vertical movement of the beam carrier can thus be transmitted securely and with stability onto the steering rod for straight guidance.

A particularly high degree of flexibility is ensured for the use of the device of the invention by that development of the invention in which the rotary bearing of the rocker is formed as an eccentric bearing on the circumference of an eccentric shaft, which eccentric shaft can be optionally driven or locked into position by means of a kinetic facility. Thus, optionally a superimposed horizontal stroke can be carried out on the beam carrier so that, depending on requirements, the fibrous web can be needled either with a horizontal stroke with a movable eccentric shaft or without a horizontal stroke with an eccentric shaft that is locked into position.

In order to achieve a high-quality needling of the non-woven web, the vertical drive is preferably formed in such a way according to a development of the invention that two connecting rods driven by separate eccentric drives are connected to the beam carrier. For this purpose, the eccentric drives each comprise a crankshaft which is connected to the connecting rod with the aid of a connecting-rod big end. The small ends of the connecting rods are connected to the beam carrier with the aid of swivel joints. Such a vertical drive provides a high degree of flexibility in adjusting and guiding the needle beam in order to needle different fibrous webs having different fibers in a manner that is specific to the product.

When designing such a vertical drive, the rocker and the coupling kinematic mechanism of the guiding device are preferably disposed between the connecting rods of the vertical drive in order to achieve very narrow thread spacing. However, it is alternately also possible to arrange the rocker and the coupling kinematic mechanism next to the connecting rods of the vertical drive in order to enable a lateral arrangement of the guiding device, for example.

The device of the invention is designed advantageously for implementing large working widths with appropriately long needle boards even with several vertical drives which are strung together in a machine and which jointly act on a beam carrier. In doing so, a straight guidance is assigned to each of the vertical drives, the rockers of which are each connected to the beam carrier with the aid of a coupling kinematic mechanism.

A superimposed horizontal movement of the needle beam can also be implemented advantageously by a development of the invention, in which the vertical drive comprises a phase-adjusting device for the phase adjustment of the two crankshafts. In this case, the crankshafts can be driven such that they are offset by a phase angle so that the beam carrier carries out a tilting movement which also results in a horizontal movement in addition to the vertical movement due to the vertical distance from the needles. This development of the invention is particularly advantageous in order to carry out small, infinitely adjustable horizontal strokes on the needle beam.

BRIEF DESCRIPTION OF THE SEVERAL VIEWS OF THE DRAWINGS

Some exemplary embodiments of the invention will be described below for explaining the invention in more detail with reference to the attached Figures, in which.

DETAILED DESCRIPTIONS

Figure 1:
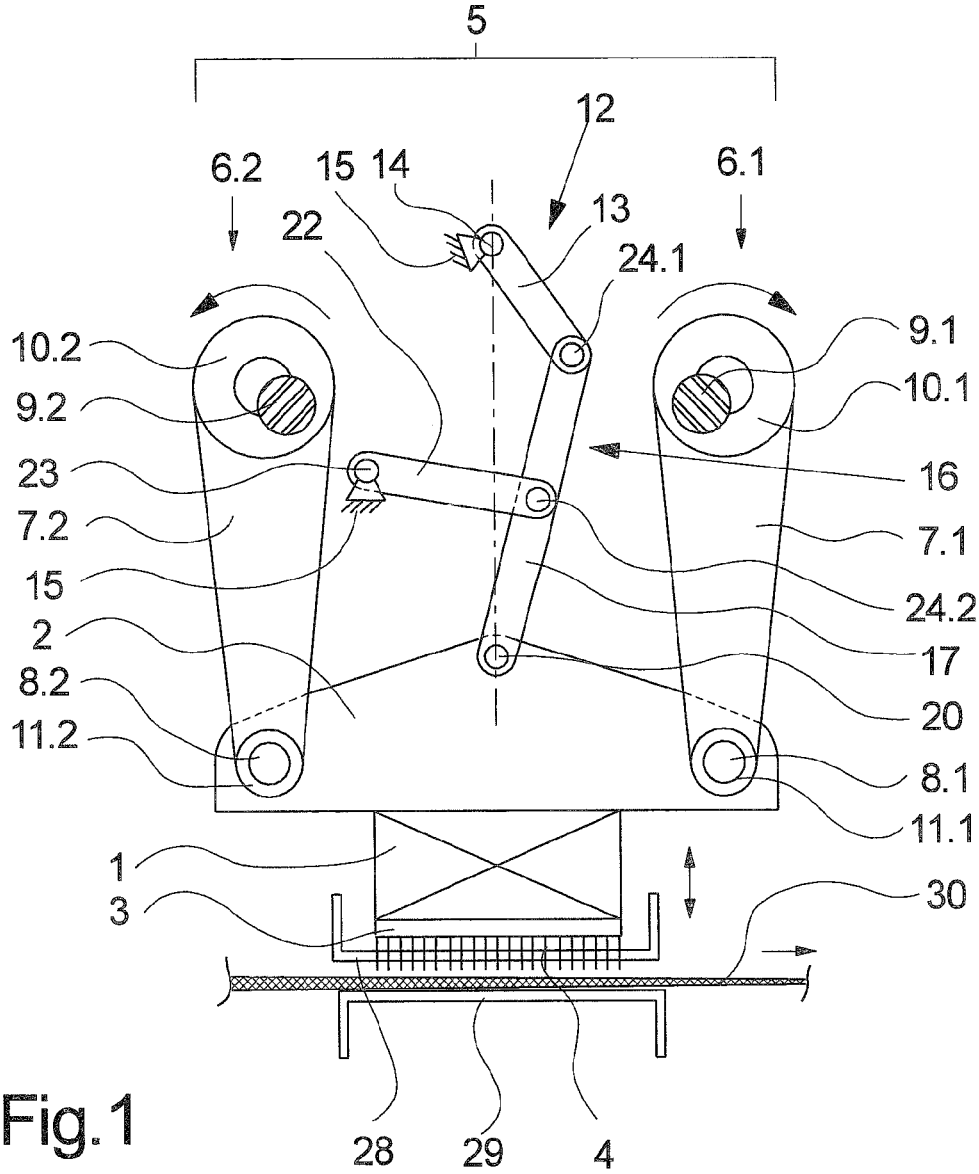
FIG. 1 schematically shows a side view of a first exemplary embodiment of the device of the invention FIG. 2 schematically shows a side view of another exemplary embodiment of the device of the invention FIG. 3 schematically shows a side view of another exemplary embodiment of the device of the invention FIG. 4 schematically shows a side view of another exemplary embodiment of the device of the invention FIG. 5 schematically shows a side view of another exemplary embodiment of the device of the invention

FIG. 1 shows a first exemplary embodiment of the device of the invention for needling a fibrous web. The exemplary embodiment of the device of the invention shown in FIG. 1 shows a beam carrier 2, which holds a needle beam 1 on the lower side thereof. The lower side of the needle beam 1 comprises a needle board 3 having a plurality of needles 4. A bedplate 29 and a stripper 28 are assigned to the needle board 3 comprising the needles 4, a fibrous web 30 being guided at a substantially constant feed rate between the bedplate 29 and the stripper 28. An arrow indicates the direction of movement of the fibrous web 30.

A vertical drive 5 acts on the beam carrier 2. The vertical drive 5 drives the beam carrier 2 in the vertical direction in an oscillating manner so that the needle beam 1 comprising the needle board 3 carries out upward and downward movements. The vertical drive 5 is formed by two eccentric drives 6.1 and 6.2 disposed parallel to each other in this exemplary embodiment. The eccentric drives 6.1 and 6.2 comprise two crankshafts 9.1 and 9.2 respectively, which are disposed parallel to each other above the beam carrier 2. The crankshafts 9.1 and 9.2 each comprise at least one eccentric portion for receiving at least one connecting rod. FIG. 1 shows the connecting rods 7.1 and 7.2, which are disposed on the beam carrier 2 and the connecting-rod big ends 10.1 and 10.2 are held on the crankshafts 9.1 and 9.2 respectively. The opposing small ends 11.1 and 11.2 of the connecting rods 7.1 and 7.2 are connected to the beam carrier 2 with the aid of two connecting swivel joints 8.1 and 8.2 respectively. The crankshaft 9.1 together with the connecting rod 7.1 and the crankshaft 9.2 together with the connecting rod 7.2 form the eccentric drives 6.1 and 6.2 respectively in order to guide the beam carrier 2 in an upward and downward movement. The crankshafts 9.1 and 9.2 are driven synchronously in the same or opposite direction so that the beam carrier 2 is guided in an at least approximately parallel manner.

For effecting the vertical movement of the beam carrier 2, a guiding device 12 is provided, which in this exemplary embodiment comprises a rocker 13, which is connected to a machine frame 15 via a rotary bearing 14. The free end of the rocker 13 is connected to the beam carrier 2 with the aid of a coupling kinematic mechanism 16. In this exemplary embodiment, the coupling kinematic mechanism 16 is formed by a steering rod 17 and a second rocker 22. The second rocker 22 is held in a pivoting manner on the machine frame 15 at a distance from the first rocker 13 with the aid of a second rotary bearing 23. The free end of the first rocker 13 and the free end of the second rocker 22 are coupled to the steering rod 17 at a distance from each other by means of swivel joints 24.1 and 24.2 respectively. The swivel joints 24.1 and 24.2 are formed at an end section of the steering rod 17. The opposite end section of the steering rod 17 is connected to the beam carrier 2 with the aid of a swivel joint 20. The swivel joint 20 is formed at the center of the beam carrier 2.

The rocker 13 and the members of the coupling kinematic mechanism 16 are disposed above the beam carrier 2. For this purpose, the rotary bearings 14 and 23 are disposed on the machine frame 15 between the connecting rods 7.1 and 7.2 of the vertical drive 5. This arrangement results in a very compact and narrow design. The vertical drive 5 and the guiding device 12 thus form a compact unit above the beam carrier 2.

The positions of the rotary bearings 14 and 23 and the lengths of the first rocker 13 and the second rocker 22 are selected such that the steering rod 17 carries out a straight guidance of the beam carrier 2 on the pivot point of the beam carrier 2, which pivot point is determined by the swivel joint 20, in the vertical direction over the entire stroke of the vertical drive 5. The straight guidance of the beam carrier 2 is advantageously implemented in relation to the machine frame 15 exclusively with the aid of rotational movements of the parts of the guiding device 12. The rotary bearings 14 and 23 and the swivel joints 24.1, 24.2 and 20 can be implemented in a low-friction manner so that an overall low-friction straight guidance of the beam carrier 2 is achieved, which does not require any additional torque by way of the vertical drive 5. An additional advantage of the use of the rotary bearings 14 and 23 and swivel joints 20, 24.1, 24.2 is that commercially available lubrication systems can be used that have a sealing effect in relation to the ambience to prevent any lubricant residue from escaping into the ambience.

During operation, the crankshafts 9.1 and 9.2 of the vertical drive 5 are preferably driven in opposite directions of rotation and at equal rotational speeds. By means of the connecting rods 7.1 and 7.2, the movement of the crankshafts 9.1 and 9.2 is transmitted to the beam carrier 2, which carries out an upward and downward movement. The vertical movement of the beam carrier 2 is received by the steering rod 17 of the guiding device 12 and transmitted to the rockers 13 and 22. The rockers 13 and 22 held in place on the rotary bearings 14 and 23 carry out a rotational movement. The kinematics of the rocker 13, the rocker 22 and the steering rod 17 is selected such that the free end of the steering rod 17 comprising the swivel joint 20 is moved on a plumb line. The beam carrier 2 is thus held on a straight guideway during the entire stroke of the vertical drive 5.

In the exemplary embodiment shown in FIG. 1, the members of the coupling kinematic mechanism 16 for linking the rocker 13 to the beam carrier 2 are formed as a steering rod and a second rocker by way of example. In principle, the members of the coupling kinematic mechanism 16 can be implemented using different lever geometries.

Figure 2:
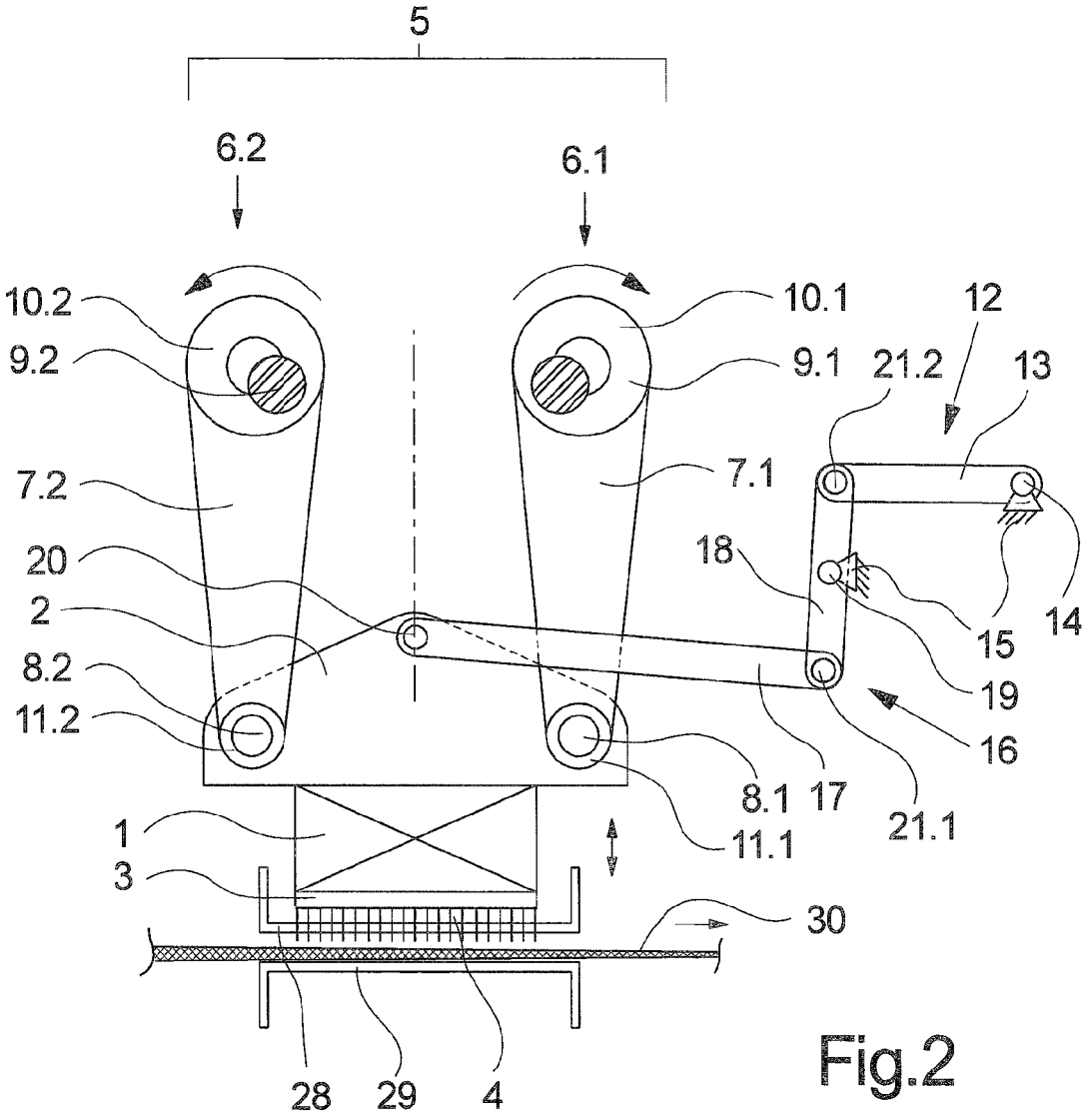

The exemplary embodiment of the device of the invention shown in FIG. 2 merely represents one additional possibility of connecting the rocker, which is locked into position on the machine frame by the rotary bearing, to the beam carrier with the aid of a coupling kinematic mechanism for the straight guidance of the beam carrier.

The exemplary embodiment shown in FIG. 2 is identical to the one cited above in terms of construction and design of the vertical drive 5, the beam carrier 2 and the devices held by the beam carrier 2 so that reference is made to the above description. As opposed to the exemplary embodiment shown in FIG. 1, the guiding device 12 in the exemplary embodiment illustrated in FIG. 2 is disposed substantially next to the connecting rods 7.1 and 7.2. For this purpose, the guiding device 12 comprises a rocker 13 which is locked into position on a rotary bearing 14 in relation to a machine frame 15. The rocker 13 is pivoted in the rotary bearing 14.

The coupling kinematic mechanism 16 is formed by a rocker arm 18 and a steering rod 17 for linking the rocker 13 to the beam carrier 2. The rocker arm 18 is held laterally above the beam carrier 2 on a rotary bearing 19 in the machine frame 15. The rocker arm 18 is articulated on the rotary bearing 19 so that a free upper end and a free lower end can be pivoted relative to the rotary bearing 19. The free upper end of the rocker arm 18 is pin-jointed with the free end of the rocker 13 with the aid of a swivel joint 21.2. The lower end of the rocker arm 18 is pin-jointed with the steering rod 17 with the aid of the swivel joint 21.1. The free end of the steering rod 17 protrudes up to the center of the beam carrier 2 and is pin-jointed there with the beam carrier 2 with the aid of the swivel joint 20.

The vertical movement of the beam carrier 2, which is driven by the vertical drive 5, is maintained by means of the steering rod 17 in a guideway determined by the kinematics of the guiding device 12. The beam carrier 2 can be guided on an approximately straight guideway depending on the length of the steering rod 17. Here too, the translatory motion of the beam carrier 2 is guided solely by rotational movements of the parts of the guiding device 12.

The exemplary embodiment of the device of the invention shown in FIG. 2 is particularly suitable for optionally driving the beam carrier with a superimposed horizontal stroke. For this purpose, the rotary bearing 14 of the rocker 13 is replaced with an eccentric bearing and an eccentric shaft which is driven by means of a kinetic facility for transmitting a horizontal stroke into the rocker 13. The straight guidance can thus be utilized for the transmission of a horizontal stroke. If the beam carrier is intended to be driven only in an oscillating vertical movement, the eccentric shaft is locked into position so that the eccentric bearing exclusively acts as the rotary bearing of the rocker. Thus, no more horizontal movement is transmitted into the rocker.

Figure 3:
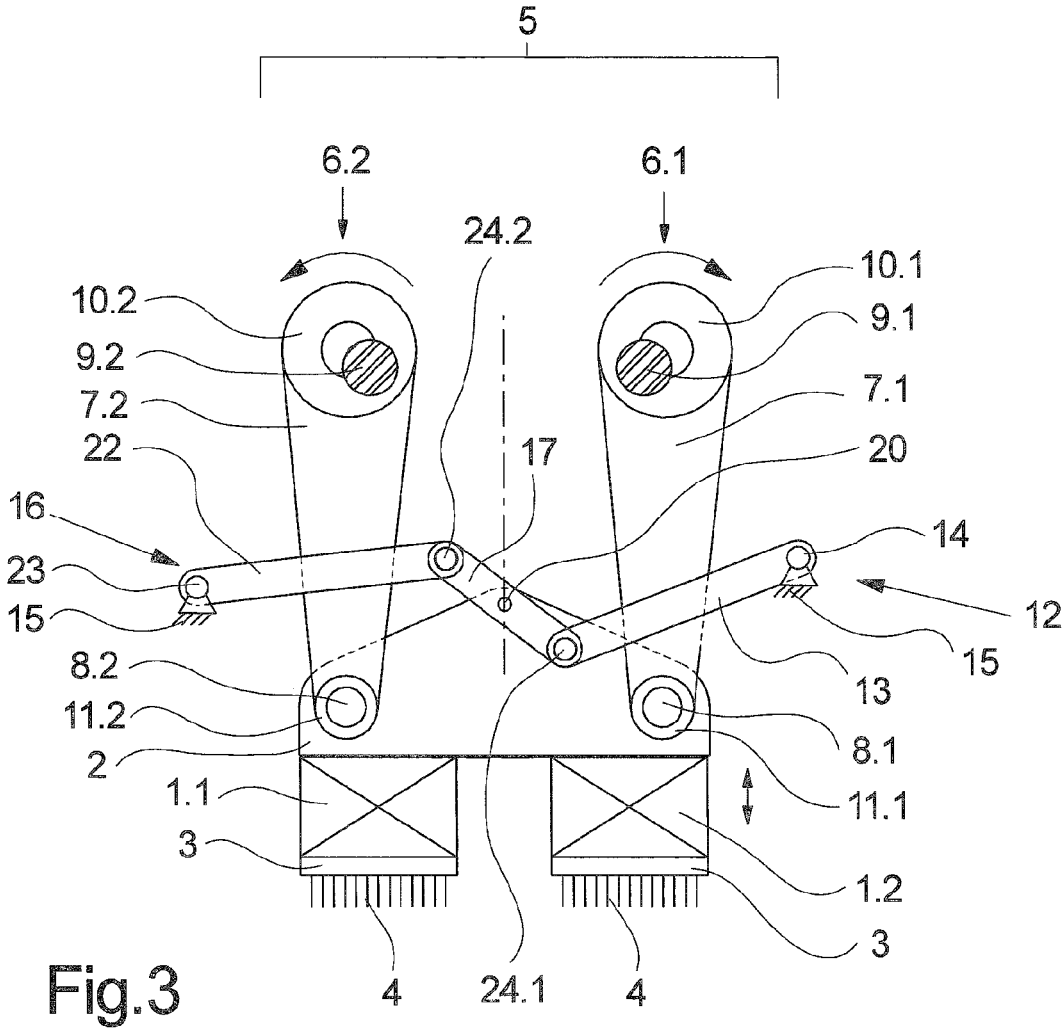

FIG. 3 schematically shows the side view of another exemplary embodiment of the device of the invention. The exemplary embodiment shown in FIG. 3 is essentially identical to the one shown in FIG. 1 so that only the differences will be explained at this point and reference is made to the above description in all other respects.

In the exemplary embodiment shown in FIG. 3, two needle beams 1.1 and 1.2, each of which carries a needle board 3 and a plurality of needles 4 on the lower side thereof, are held on the beam carrier 2. The beam carrier 2 is coupled to a vertical drive 5 which is designed identically to the one in the exemplary embodiment described above. For the straight guidance of the beam carrier 2, a guiding device 12 is provided, which consists of a first rocker 13 and a second rocker 22. The first rocker 13 is locked into position on the machine frame 15 with the aid of the rotary bearing 14. For this purpose, the rotary bearing 14 is disposed laterally next to the beam carrier 2. The second rocker 22 is held on a rotary bearing 23, which is disposed on the machine frame 15 on the opposite side of the beam carrier 2. The first rocker 13 and the second rocker 22 protrude on opposite sides up to the center of the beam carrier 2. In the central portion of the beam carrier 2, a steering rod 17 is provided, the central portion of which is connected to the beam carrier 2 via a swivel joint 20. The free ends of the steering rod 17 are coupled to the first rocker 13 and the second rocker 22 with the aid of the swivel joints 24.1 and 24.2 respectively.

In the guiding device 12 shown in FIG. 3, the rockers 13 and 22 have equal length. In order to achieve a guideway at the pivot point of the steering rod 17 in relation to the beam carrier 2, which guideway results from the rotational movements of the rockers 13 and 22, the rockers 13 and 22 are disposed at varying angular positions relative to the beam carrier 2. During the vertical movement of the beam carrier 2, an approximately straight guideway can therefore be produced at the pivot point of the steering rod 17 that is determined by the swivel joint 20.

A very stable guidance of the beam carrier 2 is achieved as a result of the symmetrical arrangement of the guiding device 12 and the bilateral linkage to the machine frame 15 with the aid of the rotary bearings 14 and 23.

The aforementioned exemplary embodiments of the devices of the invention are suitable for needling a fibrous web, in which the needles are guided in a vertical upward and downward movement. The straight guidance of the beam carrier is due to the fact that the needles carry out the most precise vertical movement possible.

Figure 4:
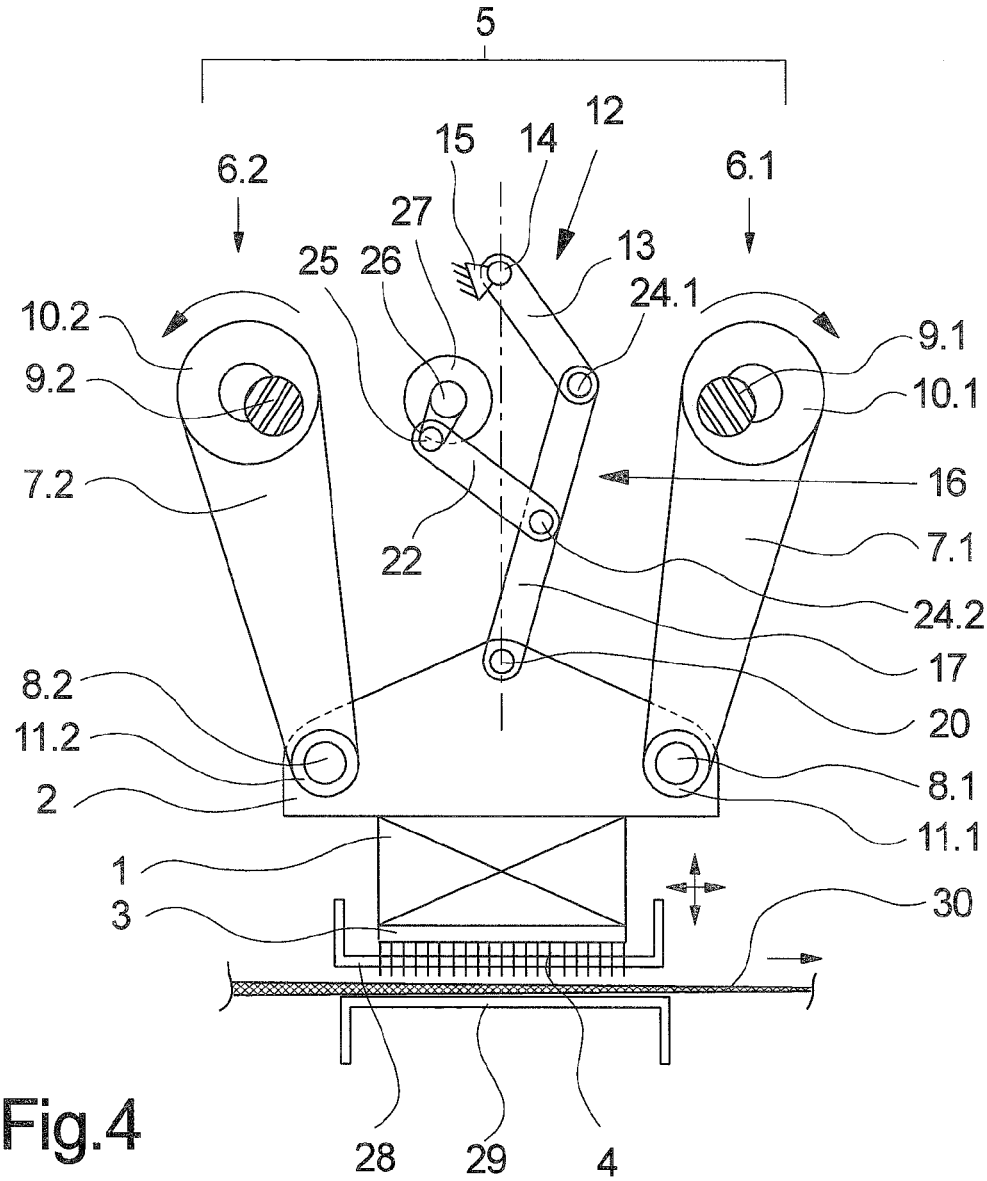

If the needles for needling the fibrous web have to carry out a superimposed horizontal movement in addition to a pure vertical movement, the guiding device 12 can be upgraded advantageously in such a way that the beam carrier 2 optionally carries out a reciprocating motion in addition to the upward and downward movement. FIG. 4 schematically shows a side view of an exemplary embodiment of the device of the invention. The exemplary embodiment is identical to the one shown in FIG. 1 so that reference is made to the above description and only the differences will be explained below.

As opposed to the exemplary embodiment shown in FIG. 1, the rotary bearing of the second rocker 22 is replaced with an eccentric bearing 25 within the guiding device 12 in the exemplary embodiment shown in FIG. 4. The eccentric bearing 25 is formed on an eccentric shaft 26 that drives the rocker 22 when rotated. The eccentric shaft 26 is coupled to a kinetic facility 27 by means of which the eccentric shaft 26 can optionally be locked into position or driven.

In the case of an eccentric shaft 26 that is locked into position, the rocker 22 is locked into position by means of the eccentric bearing 25 and can be guided around the eccentric bearing 25 only in a rotational movement. In this situation, the steering rod 17 acts in relation to the beam carrier 2 exclusively for guiding the vertical movement of the beam carrier. For this purpose, the free end of the steering rod 17 in the swivel joint 20 is preferably guided on a plumb line so that the beam carrier 2 achieves a straight guidance during the vertical stroke.

If the kinetic facility 27 drives the eccentric shaft 26, the beam carrier 2 is driven in a constant horizontal stroke that it is superimposed in relation to the vertical movement. The steering rod 17 acts as a push rod and guides the beam carrier 2 with the aid of the swivel joint 20 in a superimposed horizontal movement. The beam carrier 2 and thus the needle beam 1 carry out an elliptical movement. The rotational speed of the eccentric shaft 26 and that of the crankshafts 9.1 and 9.2 of the vertical drive 5 are equal in this case so that a horizontal stroke of the needle beam 1 can be adjusted depending on the eccentricity of the eccentric shaft 26.

In the exemplary embodiment shown in FIG. 4, the rotary bearing 14 of the rocker 13 could alternately also be formed by an eccentric bearing on an eccentric shaft for implementing a superimposed horizontal movement on the beam carrier 2 so that a horizontal component motion is introduced via the rocker 13 when the eccentric shaft is driven. The second rocker 22 would be guided on a rotary bearing on the machine frame. However, it would also be possible for both the rockers to be held on eccentric shafts, which would then be selectively driven or locked into position by a kinetic facility.

The device of the invention for needling a fibrous web thus offers a high degree of flexibility for guiding and driving a needle beam. In particular, purely vertical needling processes can be achieved for producing high-quality fiber products having uniform fiber structure.

Figure 5:
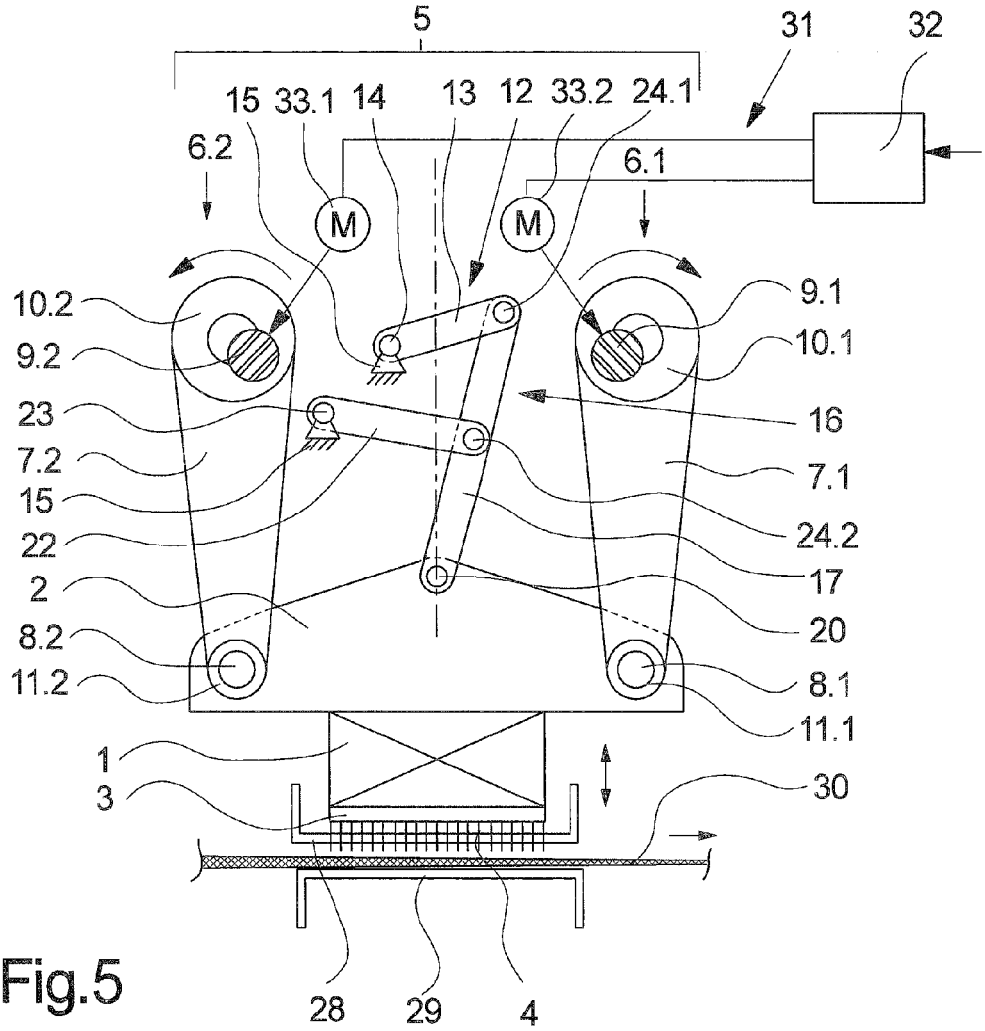

FIG. 5 schematically shows a side view of another exemplary embodiment of the device of the invention. The exemplary embodiment shown in FIG. 5 is identical to the one shown in FIG. 1 except for the vertical drive 5 so that only the differing features of the vertical drive will be explained at this point and reference is made to the above description in all other respects.

In the exemplary embodiment shown in FIG. 5, a phase-adjusting device 31 is assigned to the vertical drive 5. The phase-adjusting device 31 comprises two actuators 33.1 and 33.2 that are assigned to the crankshafts 9.1 and 9.2. The actuators 33.1 and 33.2 are connected to a control device 32. The actuators 33.1 and 33.2 can be activated with the aid of the control device 32 independently of each other in order to rotate the crankshafts 9.1 and 9.2 in their bearings. A phase position between the crankshafts 9.1 and 9.2 can thus be adjusted in any desired manner. In addition to the purely vertical upward and downward movement of the needle beam 1, a superimposed horizontal movement can thus also be effected on the beam carrier 2. Therefore, an approximately vertical upward and downward movement is carried out in the case of a phase balance of the crankshafts 9.1 and 9.2 and a synchronous drive of both the crankshafts. In the case of an offset in the phase positions of the crankshafts 9.1 and 9.2, an oblique positioning of the beam carrier 2 is effected by the connecting rods 7.1 and 7.2. In the case of an advancing movement, this oblique positioning of the beam carrier generates a component motion that is directed in the movement direction of the fibrous web 30. The magnitude of the phase adjustment between the crankshafts 9.1 and 9.2 is directly proportional to the stroke length of the horizontal movement. The stroke of the horizontal movement can therefore be adjusted infinitely via the angle of phase difference of the crankshafts 9.1 and 9.2.

The phase-adjusting device 31 could alternately also be formed by an actuator and an adjustment mechanism acting on the crankshafts 9.1 and 9.2. In this case, it is essential to drive the crankshafts 9.1 and 9.2 such that they are offset in relation to each other by a phase angle in order to enable a horizontal movement for needling the fibrous web in addition to the vertical movement.

In this case also, the guiding movement of the beam carrier is carried out with the aid of the guiding device 12, which takes place as in the exemplary embodiment shown in FIG. 1, by means of the rocker 13 and the coupling kinematic mechanism 16 consisting of a steering rod 17 and the second rocker 22.

The exemplary embodiments of the device of the invention for needling a fibrous web shown in the FIGS. 1 to 4 serve as examples of the design and construction of the guiding device for the straight guidance of the beam carrier. In principle, the coupling kinematic mechanism can also comprise more than two members in order to couple the rocker with the beam carrier. Likewise, a plurality of vertical drives can act on one beam carrier at the same time. In doing so, one of several straight guidances can be assigned to each of the vertical drives or a group of vertical drives.

The invention claimed is:

1. A device for needling a fibrous web, comprising:

at least one needle beam, the lower side of which comprises a needle board having a plurality of needles;

a movably held beam carrier for holding the needle beam;

a vertical drive connected to the beam carrier for driving the beam carrier in an oscillating manner in upward and downward movements; and a guiding device for the straight guidance of the beam carrier, the guiding device comprising at least one rocker, one end of which is held by a rotary bearing disposed on a machine frame, wherein the opposite end of the rocker and the beam carrier are connected by means of a coupling kinematic mechanism having a plurality of members, wherein the guiding device guides the beam carrier in a substantially vertical direction.

2. The device according to claim 1, wherein the members of the coupling kinematic mechanism are formed by a steering rod and a frame lever, the steering rod being connected to the beam carrier with the aid of a swivel joint, and the frame lever being held on the machine frame with the aid of a rotary bearing.

3. The device according to claim 2, wherein the frame lever is formed as a rocker arm, which comprises the rotary bearing in a central portion thereof, one end of the rocker arm being connected to the steering rod with the aid of a swivel joint and the opposite end being connected to the rocker with the aid of a second swivel joint.

4. The device according to claim 2, wherein the frame lever is formed as a second rocker, and wherein a first rocker and the second rocker are each connected to the steering rod with the aid of a swivel joint.

5. The device according to claim 4, wherein the swivel joints of the rockers are formed on the steering rod at a distance from each other, the swivel joint between the beam carrier and the steering rod being formed at a free end of the steering rod or in a central portion of the steering rod.

6. The device according to claim 4, wherein the two rotary bearings of the rockers are disposed at a distance from each other above the beam carrier.

7. The device according to claim 6, wherein the two rotary bearings of the rockers are disposed symmetrically in relation to the center of the beam carrier.

8. The device according to claim 2, wherein the beam carrier comprises the swivel joint for connecting the steering rod to the center of the beam carrier.

9. The device according to claim 1, wherein the vertical drive is formed by two eccentric drives, each of which comprises a crankshaft and a connecting rod connected to the crankshaft by means of a connecting-rod big end, the small ends of the connecting rods being connected to the beam carrier with the aid of swivel joints respectively.

10. The device according to claim 9, wherein the rocker and the members of the coupling kinematic mechanism are disposed between the connecting rods of the vertical drive or next to the connecting rods of the vertical drive.

11. The device according to claim 9, wherein the vertical drive comprises a phase-adjusting device for the phase adjustment of the two crankshaft.

12. A device for needling a fibrous web, comprising:

at least one needle beam, the lower side of which comprises a needle board having a plurality of needles;

a movably held beam carrier for holding the needle beam;

a vertical drive connected to the beam carrier for driving the beam carrier in an oscillating manner in upward and downward movements; and a guiding device for the straight guidance of the beam carrier, the guiding device comprising at least one rocker, one end of which is held by a rotary bearing disposed on a machine frame, wherein the opposite end of the rocker and the beam carrier are connected by means of a coupling kinematic mechanism having a plurality of members, wherein the guiding device guides the beam carrier in a substantially vertical direction, wherein the vertical drive comprises a phase-adjusting device for the phase adjustment of the two crankshafts, and wherein in addition to substantially vertical movement of the beam carrier, a tilting movement is effected on the beam carrier.

13. The device according to claim 12, wherein the members of the coupling kinematic mechanism are formed by a steering rod and a frame lever, the steering rod being connected to the beam carrier with the aid of a swivel joint, and the frame lever being held on the machine frame with the aid of a rotary bearing.

14. The device according to claim 13, wherein the frame lever is formed as a rocker arm, which comprises the rotary bearing in a central portion thereof, one end of the rocker arm being connected to the steering rod with the aid of a swivel joint and the opposite end being connected to the rocker with the aid of a second swivel joint.

15. The device according to claim 13, wherein the frame lever is formed as a second rocker, and wherein a first rocker and the second rocker are each connected to the steering rod with the aid of a swivel joint.

16. The device according to claim 15, wherein the swivel joints of the rockers are formed on the steering rod at a distance from each other, the swivel joint between the beam carrier and the steering rod being formed at a free end of the steering rod or in a central portion of the steering rod.

17. The device according to claim 15, wherein the two rotary bearings of the rockers are disposed at a distance from each other above the beam carrier.

18. The device according to claim 17, wherein the two rotary bearings of the rockers are disposed symmetrically in relation to the center of the beam carrier.

19. The device according to claim 13, wherein the beam carrier comprises the swivel joint for connecting the steering rod to the center of the beam carrier.

20. The device according to claim 12, wherein the vertical drive is formed by two eccentric drives, each of which comprises a crankshaft and a connecting rod connected to the crankshaft by means of a connecting-rod big end, the small ends of the connecting rods being connected to the beam carrier with the aid of swivel joints respectively.

21. The device according to claim 20, wherein wherein the rocker and the members of the coupling kinematic mechanism are disposed between the connecting rods of the vertical drive or next to the connecting rods of the vertical drive.

* * * * *

UNITED STATES PATENT AND TRADEMARK OFFICE

CERTIFICATE OF CORRECTION

PATENT NO. : 8,156,618 B2
APPLICATION NO. : 12/669763
DATED : April 17, 2012
INVENTOR(S) : Reutter et al.

It is certified that error appears in the above-identified patent and that said Letters Patent is hereby corrected as shown below:

Title page,
Insert the following:
--(73) Assignee: Hi Tech Textile Holding GmbH, Leonding (AT)--

Signed and Sealed this
Second Day of April, 2013

Teresa Stanek Rea
*Acting Director of the United States Patent and Trademark Office*